US007608020B2

(12) United States Patent
Mason

(10) Patent No.: US 7,608,020 B2
(45) Date of Patent: Oct. 27, 2009

(54) ARM AND SHOULDER LIFT APPARATUS

(76) Inventor: Christopher M. Mason, 2935 Donavan Pl., Winston Salem, NC (US) 27103

( * ) Notice: Subject to any disclaimer, the term of this patent is extended or adjusted under 35 U.S.C. 154(b) by 17 days.

(21) Appl. No.: 12/020,621

(22) Filed: Jan. 28, 2008

(65) Prior Publication Data

US 2009/0192026 A1 Jul. 30, 2009

(51) Int. Cl.
*A63B 21/08* (2006.01)
*A63B 21/065* (2006.01)

(52) U.S. Cl. ..... 482/97; 482/98; 482/105

(58) Field of Classification Search ..... 482/92–94, 482/97, 98, 104–106, 136–139; D21/673, D21/675, 686
See application file for complete search history.

(56) References Cited

U.S. PATENT DOCUMENTS 3,003,765 A * 1/1961 Dove ..... 482/97
3,866,914 A 2/1975 Jackson
4,357,010 A 11/1982 Telle
4,406,452 A * 9/1983 Lapcevic ..... 482/97
4,465,274 A * 8/1984 Davenport ..... 482/113
4,540,171 A 9/1985 Clark et al.
4,765,611 A 8/1988 MacMillan
4,828,252 A 5/1989 Bowen et al.
4,863,161 A * 9/1989 Telle ..... 482/97
4,872,670 A * 10/1989 Nichols ..... 482/135
5,050,868 A 9/1991 Pearson
5,058,884 A 10/1991 Fuller, Sr.
5,104,119 A * 4/1992 Lynch ..... 482/5
5,108,095 A * 4/1992 Nichols ..... 482/137
5,116,297 A * 5/1992 Stonecipher ..... 482/97
5,336,148 A * 8/1994 Ish, III ..... 482/98
5,378,209 A * 1/1995 Kendrew ..... 482/52
5,626,548 A * 5/1997 Coyle ..... 482/137
5,653,666 A 8/1997 Pantoleon
6,719,672 B1 4/2004 Ellis et al.
6,802,800 B1 * 10/2004 Hobson ..... 482/97
2004/0242383 A1 * 12/2004 Karlstrom ..... 482/93

FOREIGN PATENT DOCUMENTS

GB 2232089 A * 12/1990

* cited by examiner

*Primary Examiner*—Loan H Thanh
*Assistant Examiner*—Victor K Hwang
(74) *Attorney, Agent, or Firm*—John A. Thomas

(57) ABSTRACT

An exercise apparatus has a frame supporting a pivotable lower right arm and a lower left arm, and also a pivotable upper right arm and upper left arm. The upper right arm and the upper left arm are pivotably connected to the frame at points above the pivotable connections of the lower right arm and the lower left arm. The lower arms have handles for grasping by a user and weight pegs. The upper right arm and the upper left arm each further have a rail connected to the arm and running substantially parallel to it. A sleeve slideably engages the rail and supports a shoulder harness for a user and also weight pegs. The user grasps the handles connected to the lower arms and lifts upward, whereby his shoulders contact the resistance of the upper arms through the shoulder harness.

18 Claims, 5 Drawing Sheets

ARM AND SHOULDER LIFT APPARATUS

TECHNICAL FIELD

This disclosure relates to exercise apparatus using weight resistance, in particular to exercise apparatus directed to strengthening the muscles of the posterior chain.

BACKGROUND

The term "posterior chain" is taken by athletes and trainers to include the muscles of the calves, gluteus, hamstrings and lower back. A strong posterior chain can greatly reduce the lower back problems encountered so frequently and help avoid lower back injury. Further, training of the posterior chain is the key to explosive athletic movements such as sprinting and jumping.

Existing exercise devices aimed at strengthening the back work primarily either the upper back or the lower back. Combination devices have been developed that attempt to work both sets of muscles, or to include the hamstrings in the effort. Such combination devices are relatively complicated and expensive, or relatively ineffective in strengthening the entire posterior chain.

What is needed is a simple and effective exercise apparatus that will work all of the muscles of the posterior chain, and preferably as well the trapezium, rhomboids, latissimus dorsi and rear deltoid muscles, all in one exercise.

DRAWINGS

DESCRIPTION

Figure 1:
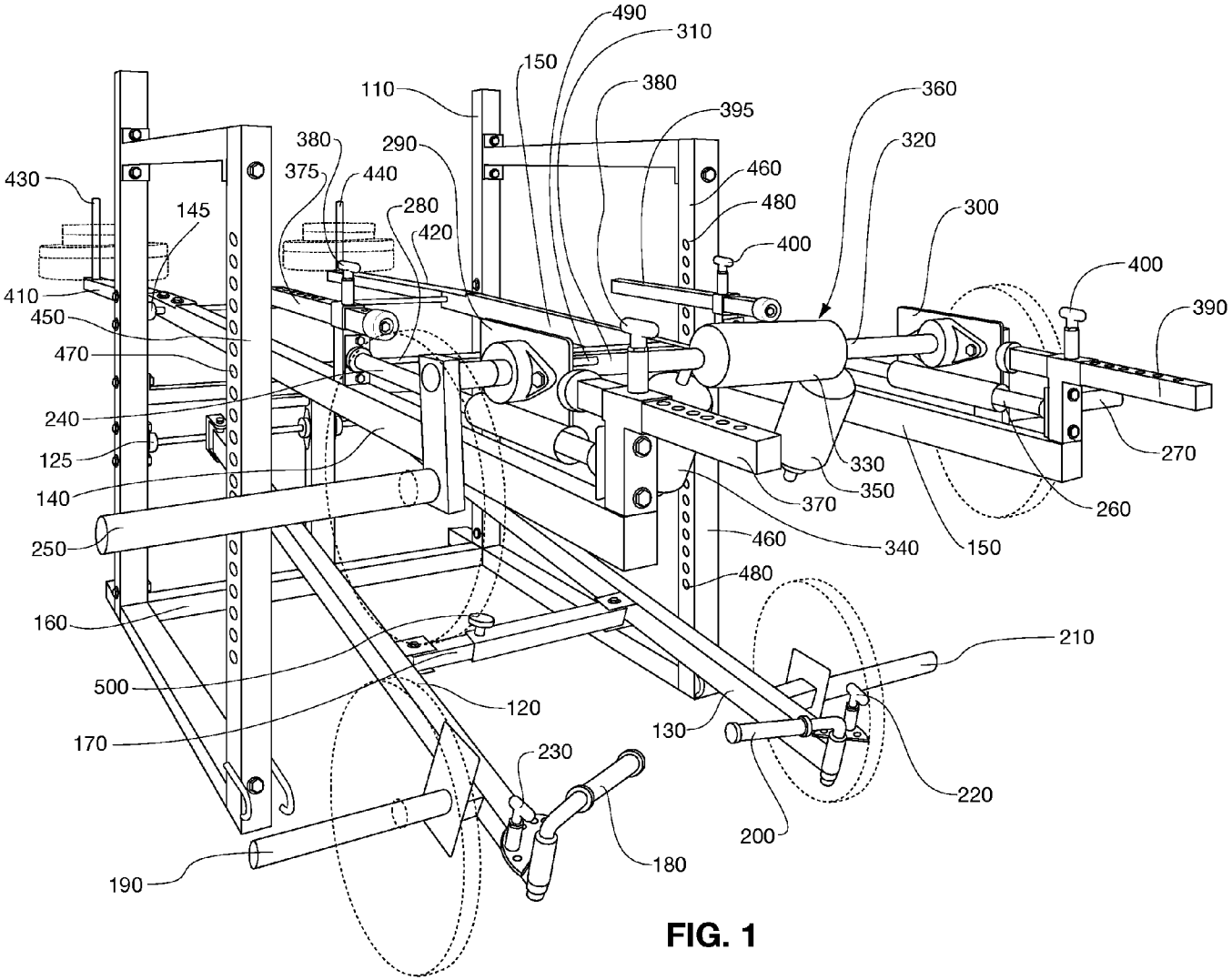
FIG. 1 shows a perspective view of an embodiment, as seen by a user stepping into position to begin an exercise.
Figure 2:
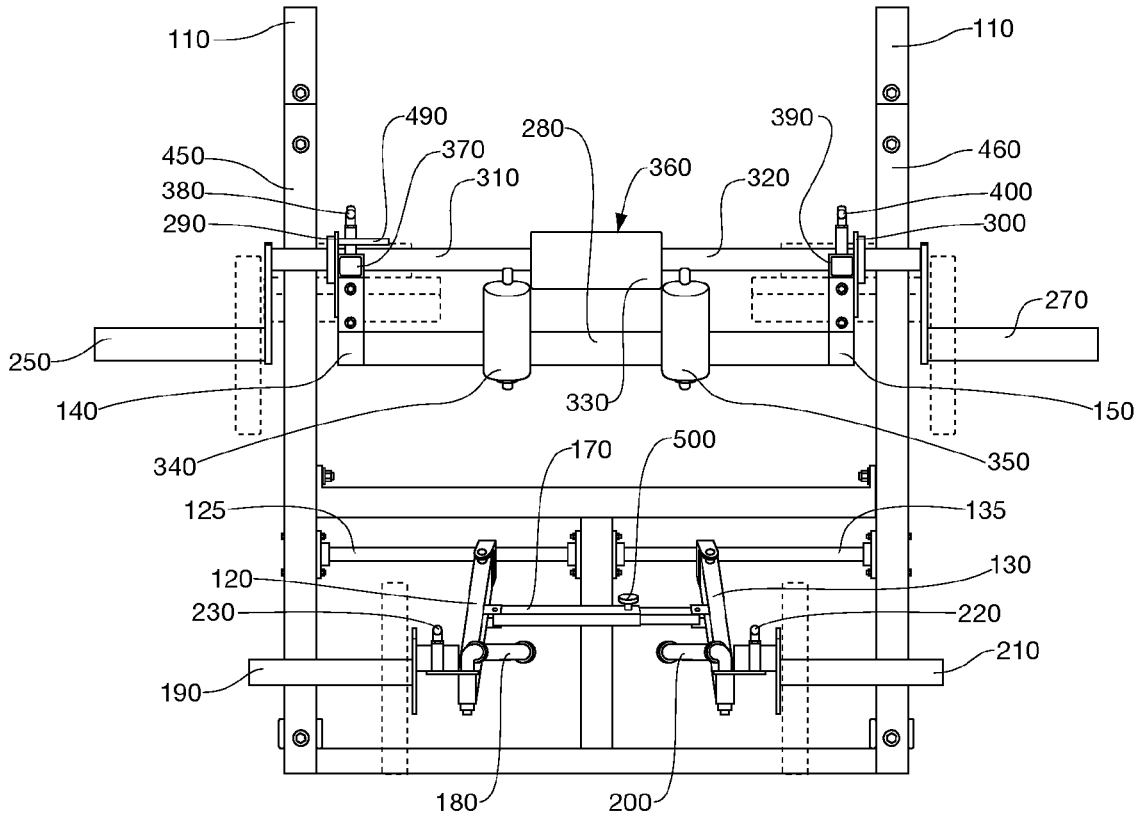
FIG. 2 shows a rear view of the same embodiment, as seen by a user stepping into position to begin an exercise.
Figure 3:
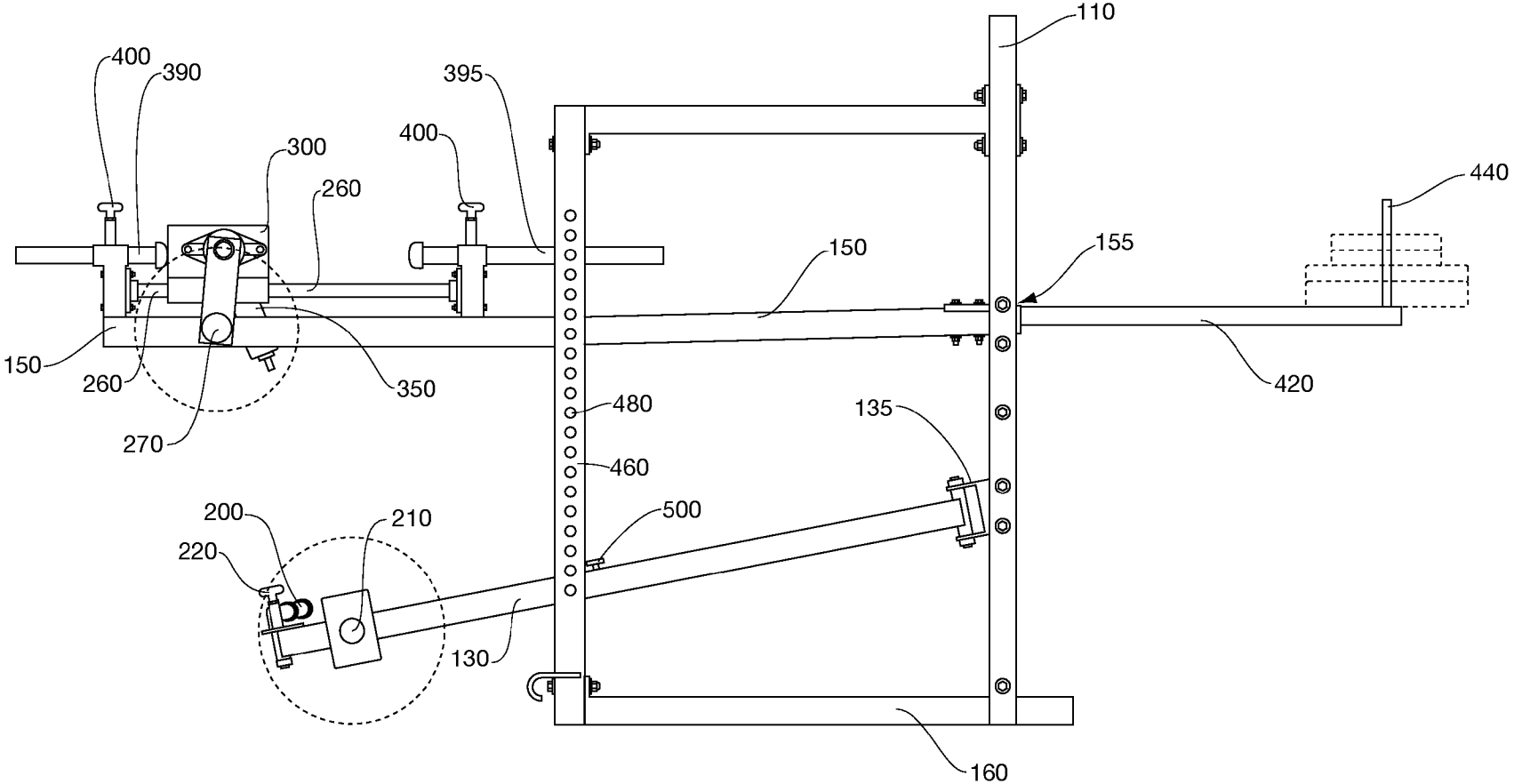
FIG. 3 shows a side view of the same embodiment.

FIG. 1 shows a perspective view of the apparatus of the preferred embodiment. "Left" and "right" in this disclosure refer to the view of a user stepping into position to begin an exercise, and correspond to left and right in FIGS. 1 and 2. A frame (110) supports a left lower pivoting arm (120), a right lower pivoting arm (130), a left upper pivoting arm (140), and a right upper pivoting arm (150), all of which pivot in a vertical plane. The left upper pivoting arm (140) is pivotably connected to the frame (110) at a left upper pivot (145), and the right upper pivoting arm (150) is pivotably connected to the frame (110) at a right upper pivot (155). The left lower pivoting arm (120) is pivotably connected to the frame (110) at a left lower pivot (125), and the right lower pivoting arm (130) is pivotably connected to the frame (110) at a right lower pivot (135). The upper pivots (145, 155) are thus connected to the frame (110) at points above the lower pivots (125, 135). The frame (110) preferably has a base (160) for strength and stability. FIGS. 2 and 3 show, respectively, a rear view and a right-side view of the embodiment.

The left lower pivoting arm (120) and right lower pivoting arm (130) are connected by a lower crossbeam (170), forcing them to pivot together. The left lower pivoting arm (120) is connected to a left handle (180) and a left lower weight bearing peg (190). The left handle (180) is oriented at a right angle to the left lower pivoting arm (120) and approximately parallel to the floor.

The right lower pivoting arm (130) is connected to a right handle (200) and a right lower weight-bearing peg (210). The right handle (200) is oriented at a right angle to the right lower pivoting arm (130) and approximately parallel to the floor upon which the apparatus rests. The left handle (180) and right handle (200) positions may be made adjustable using a left grip knob (230) and a right grip knob (220), respectively, so that a user may customize them for a comfortable and secure grip.

In this disclosure, the term "knob" is used to generally mean a hand-operated adjusting mechanism, so that parts of the apparatus, such as hand grips and arms, may be adjusted and held relative to one another. Typically, such mechanisms are pin-and-hole combinations set and unset by inserting or removing a pin or shaft attached to a knob.

The left upper pivoting arm (140) is connected to a left rail (240) and a left upper weight bearing peg (250). The right upper pivoting arm (150) is connected to a right rail (260) and a right upper weight bearing peg (270).

The left upper pivoting arm (140) and right upper pivoting arm (150) are connected by an upper crossbeam (280), forcing them to pivot together.

A left sleeve (290) is slideably engages the left rail (240) and a right sleeve (300) is slideably engages the right rail (260). The left slideable sleeve (290) is connected to a left harness support rod (310), and the right slideable sleeve (300) is connected to a right harness support rod (320). The left harness support rod (310) and the right harness support rod (320) are connected to a padded center harness rod (330). The left harness support rod (310), right harness support rod (320) and padded center harness rod (330) may alternatively be a single rod with padding surrounding a central portion of such single rod. The center harness rod (330) is, in turn, connected to a padded left harness rod (340) and a padded right harness rod (350). Together, the center harness rod (330), left harness rod (340) and right harness rod (350) form a shoulder harness (360) which will fit over the shoulders and behind the neck of a user. The shoulder harness (360) alternatively, may be constructed in one piece and padded. The left handle (180), right handle (200) and shoulder harness (360) are aligned so that a user may engage all three during exercise. The left and right harness support rods (310 and 320) are preferably rotatable in the respective sleeves (290, 300), so as to accommodate the movement of the user's shoulders as the exercise is executed.

Preferably, the axes of the left weight peg (250) and the right weight peg (270) are offset from the axes of the left harness support rod (310) and the right harness support rod (320), respectively, as shown most clearly in FIGS. 1 and 2.

The sliding movement of the left sleeve (290) is shown constrained by an adjustable left front limit bar (370) and an adjustable left rear limit bar (375). The left limit bars (370, 375) may be adjusted by left limit bar knobs (380). The sliding movement of the right sleeve (300) is shown constrained by an adjustable right front limit bar (390) and an adjustable right rear limit bar (395). The right limit bars (390, 395) may be adjusted by right limit bar knobs (400). The right limit bars (390, 395) are mounted on the right upper pivoting arm (150), and the left limit bars (370, 375) are mounted on the left upper pivoting arm (140).

The left upper pivoting arm (140) may be connected to a left counterbalance arm (410) and the right upper pivoting arm (150) may be connected to a right counterbalance arm (420) to allow a user to lift less than the weight of the structure of the apparatus otherwise encountered by a user supporting the shoulder harness (360). The left counterbalance arm (410)

is connected to a left rear weight bearing peg (430) and the right counterbalance arm (420) is connected to a right rear weight bearing peg (440).

The frame (110) is connected to a left adjustment beam (450) and a right adjustment beam (460). The left adjustment beam (450) and right adjustment beam (460) extend from the bottom to the top of the frame (110) on the side of the frame nearest the left handle (180) and right handle (200). A left series of holes (470) is disposed in a vertical line along the left adjustment beam (450), and a right series of holes (480) is disposed in a vertical line along the right adjustment beam (460).

A pin, bracket or other support mechanism (not shown) may be adjustably fixed to the left adjustment beam (450) by means of the left series of holes (470) or to the right adjustment beam (460) by means of the right series of holes (480). Doing so will allow support of either the left lower pivoting arm (120) and right lower pivoting arm (130) or the left upper pivoting arm (140) and right upper pivoting arm (150) above a respective bottom position of such pivoting arms. This is desirable to set a starting position for the exercise, which in general will be different for different persons. Sleeves (not shown) sliding along the adjustment beams (450, 460) may be used as convenient mounts for the pin or bracket.

A limiting rod (490) may be attached to the left harness support rod (310) or right harness support rod (320) or the vicinity thereof to limit the motion of the shoulder harness (360) so that the shoulder harness (360) does not fall off the user. Also, the lower crossbeam (170) may be made telescoping, with a lower crossbeam knob (500) attached to the lower crossbeam (170) to allow the distance between the left lower pivoting arm (120) and right lower pivoting arm (130) to be adjusted.

Figure 4:
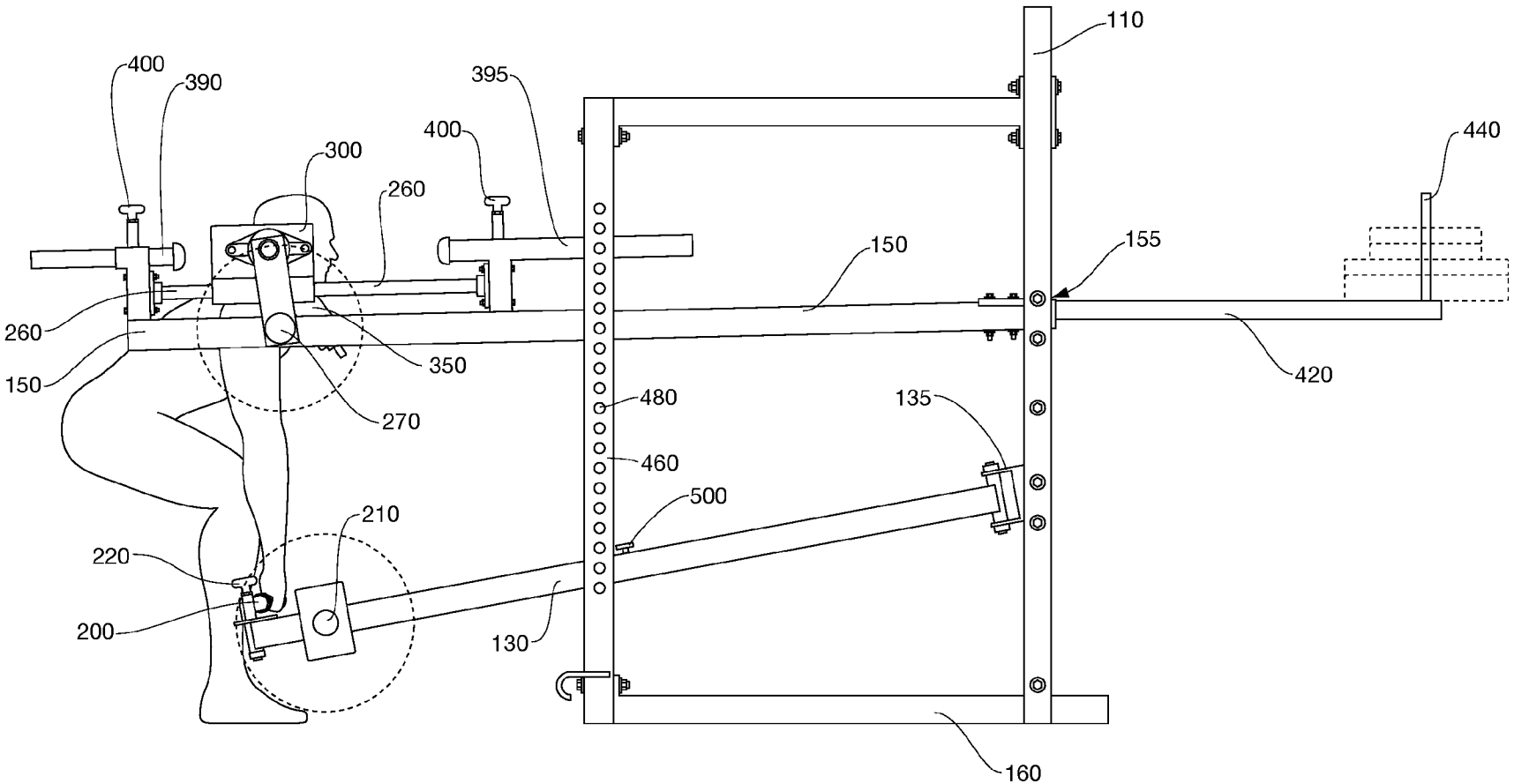
FIGS. 4 and 5 are side views showing two stages of an exercise executed by a user of the same embodiment.
Figure 5:
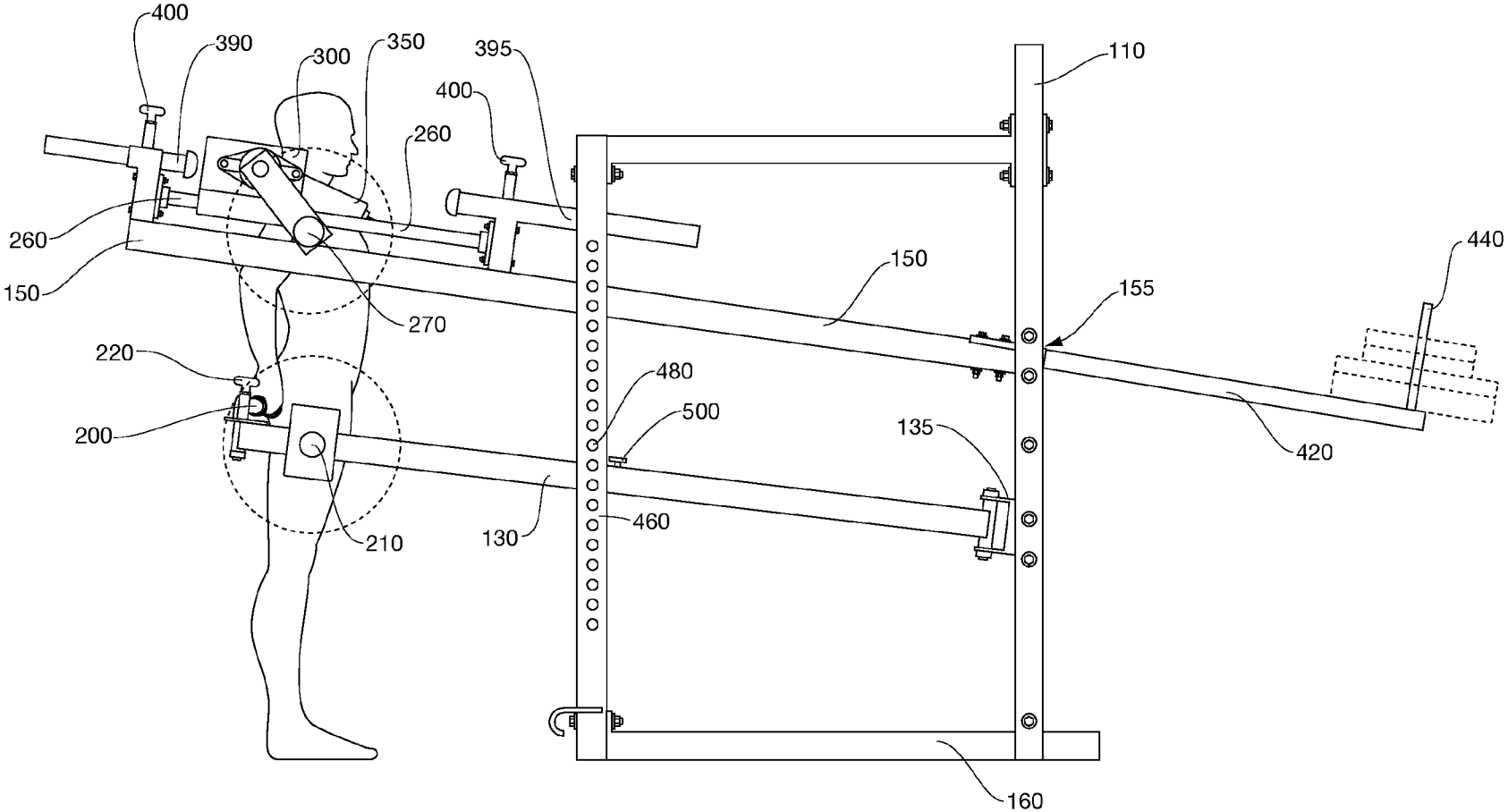

FIGS. 4 and 5 are side views illustrating the movements of a user of the exercise apparatus. A user may set a desired weight on each of the left lower weight-support peg (190), right lower weight support peg (210), left upper weight bearing peg (250), and right upper weight bearing peg (270). The weights are normally the same on the left and right sides of the apparatus, but may arranged to increase the load on one side of the user's body relative to the other if desired. The user positions himself and the shoulder harness (360) so that his neck and shoulders are framed by and supporting the shoulder harness (360), the left handle (180) and right handle (200) are in easy reach, and the user's body is in a squatting position. The user then grasps the left handle (180) and the right handles (200). The user then stands up while maintaining a hold on the left handle (180) and right handle (200), thereby also engaging the load from the shoulder harness (360). Once the user has reached a fully erect position, he returns to the initial squatting position before repeating the exercise movement.

I claim:

1. An exercise apparatus comprising:

a frame;

a lower right arm and a lower left arm; the lower right arm and the lower left arm pivotably connected to the frame;

the lower right arm and the lower left arm each having a handle for grasping by a user;

an upper right arm and an upper left arm; the upper right arm and the upper left arm pivotably connected to the frame;

the upper right arm and the upper left arm pivotably connected to the frame at points above the pivotable connections of the lower right arm and the lower left arm;

the upper right arm and the upper left arm each further comprising:

a rail connected to the arm; the rail substantially parallel to the arm;

a sleeve slideably engaging the rail;

the sleeve connected to a harness support rod;

a shoulder harness for engaging the shoulders of a user; the shoulder harness connected to the left and right harness support rods.

2. The exercise apparatus of claim 1, further comprising:

a peg for supporting weights connected to each sleeve.

3. The exercise apparatus of claim 2, where the pegs for supporting weights are offset from the axis of the harness support rods.

4. The exercise apparatus of claim 1, further comprising:

a peg for supporting weights connected to each lower arm.

5. The exercise apparatus of claim 1, further comprising:

a lower crossbeam; the lower crossbeam connected between the lower right arm and the lower left arm, so that the lower right arm and the lower left arm are forced to pivot together.

6. The exercise apparatus of claim 1, further comprising:

an upper crossbeam, the upper crossbeam connected between the upper right arm and the upper left arm, so that the upper right arm and the upper left arm are forced to pivot together.

7. The exercise apparatus of claim 1, where the left and right harness support rods are rotatable with respect to the respective sleeves.

8. The exercise apparatus of claim 1, further comprising:

right and left counterbalance arms connected respectively to the upper right arm and the upper left arm.

9. The exercise apparatus of claim 8, where the left and right counterbalance arms further comprise pegs for supporting weights.

10. The exercise apparatus of claim 1, where each upper arm further comprises:

limit bars; the limit bars adjustable to limit the travel of the sleeve along the rail.

11. The exercise apparatus of claim 1, further comprising:

the frame having right and left adjusting beams;

the left and right adjusting beams disposed on the side of the frame opposite the pivotable connections of the upper arms and the lower arms to the frame;

the left and right adjusting beams having holes for receiving pins for supporting the upper arms or the lower arms or both in an initial position.

12. An exercise apparatus comprising:

a frame;

a lower right arm and a lower left arm; the lower right arm and the lower left arm pivotably connected to the frame;

the lower right arm and the lower left arm each having a peg for supporting weights;

the lower right arm and the lower left arm each having a handle for grasping by a user;

an upper right arm and an upper left arm; the upper right arm and the upper left arm pivotably connected to the frame;

the upper right arm and the upper left arm pivotably connected to the frame above the pivotable connections of the lower right arm and the lower left arm;

the upper right arm and the upper left arm each further comprising:

a rail connected to the arm; the rail substantially parallel to the arm;

a sleeve slideably engaging the rail;

the sleeve connected to a harness support rod;

where the harness support rod is rotatable with respect to the sleeve;

the sleeve connected to a peg for supporting weights; and, limit bars; the limit bars adjustable to limit the travel of the sleeve along the rail;

a shoulder harness for engaging the shoulders of a user; the shoulder harness connected to the left and right harness support rods.

13. The exercise apparatus of claim 12, where the pegs for supporting weights connected to the sleeves are offset from the axis of the harness support rods.

14. The exercise apparatus of claim 12, further comprising:

a lower crossbeam; the lower crossbeam connected between the lower right arm and the lower left arm, so that the lower right arm and the lower left arm are forced to pivot together.

15. The exercise apparatus of claim 14, where the extension of the lower crossbeam is adjustable.

16. The exercise apparatus of claim 12, further comprising:

an upper crossbeam, the upper crossbeam connected between the upper right arm and the upper left arm, so that the upper right arm and the upper left arm are forced to pivot together.

17. The exercise apparatus of claim 12, further comprising:

right and left counterbalance arms connected respectively to the upper right arm and the upper left arm;

the right and left counterbalance arms further comprising pegs for supporting weights.

18. The exercise apparatus of claim 12, further comprising:

the frame having right and left adjusting beams;

the left and right adjusting beams disposed on the side of the frame opposite the pivotable connections of the upper arms and the lower arms to the frame;

the left and right adjusting beams having spaced holes for receiving pins for supporting the upper arms or the lower arms, or both, in an initial position.

* * * * *